US006834782B2

(12) United States Patent
Ritter

(10) Patent No.: US 6,834,782 B2
(45) Date of Patent: Dec. 28, 2004

(54) CARTRIDGE CLOSURE WITH OPENING AND CLOSING MEANS

(75) Inventor: Frank Georg Ritter, Eppishausen (DE)

(73) Assignee: Ritter GmbH, Schwabmuenchen (DE)

( * ) Notice: Subject to any disclaimer, the term of this patent is extended or adjusted under 35 U.S.C. 154(b) by 0 days.

(21) Appl. No.: 10/434,826

(22) Filed: May 9, 2003

(65) Prior Publication Data

US 2004/0134936 A1 Jul. 15, 2004

(30) Foreign Application Priority Data

Jan. 13, 2003 (DE) ..... 103 01 029

(51) Int. Cl.[7] ..... B67D 3/00

(52) U.S. Cl. ..... 222/521; 222/325; 222/525; 222/519; 222/549

(58) Field of Search ..... 222/325–327, 222/519–525, 547–549, 391, 544

(56) References Cited

U.S. PATENT DOCUMENTS 4,438,870 A * 3/1984 Stull ..... 222/48
4,589,572 A * 5/1986 Pomarolli ..... 222/83.5
4,878,604 A * 11/1989 Barriac ..... 222/209
5,181,632 A * 1/1993 Latter ..... 222/153.06
6,039,218 A * 3/2000 Beck ..... 222/153.06
6,357,634 B1 * 3/2002 Evans et al. ..... 222/525
6,758,376 B1 * 7/2004 Clodfelter et al. ..... 222/520

FOREIGN PATENT DOCUMENTS

DE 92 11 218.8 3/1993

* cited by examiner

*Primary Examiner*—J. Casimer Jacyna
(74) *Attorney, Agent, or Firm*—Klaus J. Bach

(57) ABSTRACT

In a cartridge closure with opening and closing means comprising a mouth piece with an open end and a closure part having a sleeve portion axially movably supported on the mouthpiece, a transverse wall is supported by support webs in axially spaced relationship from the open end of the mouthpiece and the closure part includes a neck portion of a smaller diameter than the sleeve portion with a transition area between the neck portion and the sleeve portion which includes a conical seal surface area which, in the closing position of the sleeve portion, sealingly engages a circumferential edge of the transverse wall.

9 Claims, 5 Drawing Sheets

Section B-B

Section A-A

Section B-B

Section A-A

Section B-B

Section A-A

Section B-B

Section A-A

Section B-B

Section A-A

Section B-B

Section A-A

Section B-B

CARTRIDGE CLOSURE WITH OPENING AND CLOSING MEANS

BACKGROUND OF THE INVENTION

The invention relates to a cartridge closure with opening and closing means comprising a mouth piece with an open end and a closure part for closing the cartridge.

Cartridges for plastic material such as sealing materials, gap fillers, cement in the form of viscous plastic compounds comprise a tubular housing which is closed at the front end by a front wall provided with a mouth piece.

Generally, the mouthpiece has a portion, which is threaded at the outside for mounting a nozzle thereon, and includes a conical tip, which is cut open when the cartridge is used. Once the cartridge has been used, it cannot be fully closed anymore.

Two-component cartridges have generally a mouthpiece with two outlets which, when the cartridge is not used, are closed by a cap, that is, a double plug, which is secured in place by a threaded sleeve cap. For use, the sleeve plug and the double plug are removed and a mixing nozzle is mounted onto the mouthpiece.

DE Gbm 202 06 461 discloses a discharge nozzle which can be closed and which can be mounted onto a conventional cartridge mouthpiece that must be cut open before the cartridge is used. The discharge nozzle includes a nozzle body with a conical tip having a side discharge opening and an outer nozzle sleeve which is also conical and has an open tip and a rear handling portion and which is threaded onto the nozzle body. Rotation of the outer nozzle sleeve is transferred by the thread into an axial movement by which the conical front part of the outer nozzle sleeve is lifted off the conical nozzle tip or is engaged therewith to open the side discharge openings or close the same. This known arrangement still requires the cutting of the cartridge mouthpiece and the subsequent mounting of the nozzle. Furthermore, this arrangement has the disadvantage that a space remains between the nozzle and the outer nozzle sleeve which extends from the nozzle discharge opening backward to the threaded portion and which forms a dead volume in which cartridge content material can collect and cause malfunctions.

It is the object of the present invention to provide an arrangement, which does not have the disadvantages referred to above.

SUMMARY OF THE INVENTION

In a cartridge closure with opening and closing means comprising a mouth piece with an open end and a closure part having a sleeve portion axially movably supported on the mouthpiece, a transverse wall is supported, by support webs, in axially spaced relationship from the open end of the mouthpiece and the closure part includes a neck portion of a smaller diameter than the sleeve portion with a transition area between the neck portion and the sleeve portion which includes a conical seal surface area which, in the closing position of the sleeve portion, sealingly engages a circumferential edge of the transverse wall.

The invention will be described in greater detail below on the basis of the accompanying drawings.

BRIEF DESCRIPTION OF THE DRAWINGS

FIG. 1 shows a top view,

FIG. 2 is a sectional view taken along line A—A of FIG. 1 with the nozzle open, FIG. 3 is a sectional view taken along line B—B of FIG. 1 with the nozzle open, FIG. 4 is a sectional view taken along line A—A of FIG. 1 with the nozzle closed, FIG. 5 is a sectional view taken along line B—B of FIG. 1 with the nozzle closed, FIG. 11 is a top view of the cartridge of the third embodiment, FIG. 12 is a sectional view taken along line A—A of FIG. 11 with the nozzle open, FIG. 13 is a sectional view taken along line A—A of FIG. 11 with the nozzle open and FIG. 14 is a sectional view taken along line B—B of FIG. 11 with the nozzle open, and FIG. 15 is a sectional view taken along line B—B of FIG. 11 with the nozzle closed.

DESCRIPTION OF THE DIFFERENT EMBODIMENTS

Figure 1:
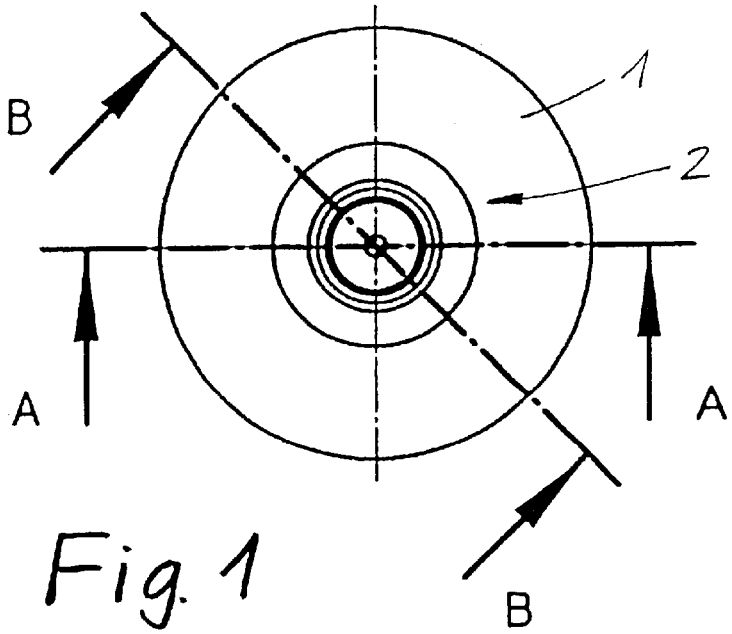
FIGS. 1 to 5 show a first embodiment of a cartridge closure according to the invention.
Figure 2:
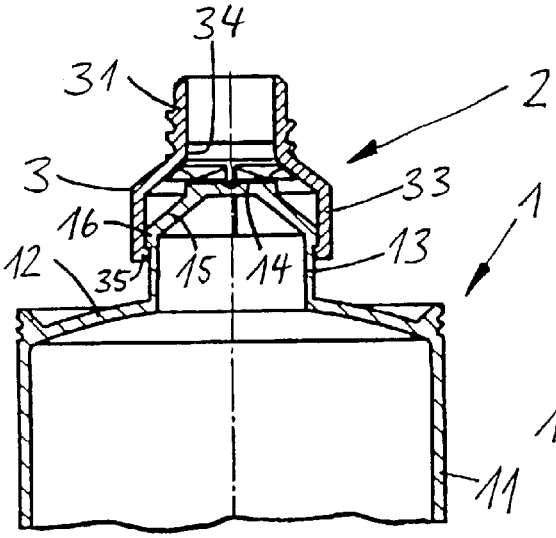
Figure 3:
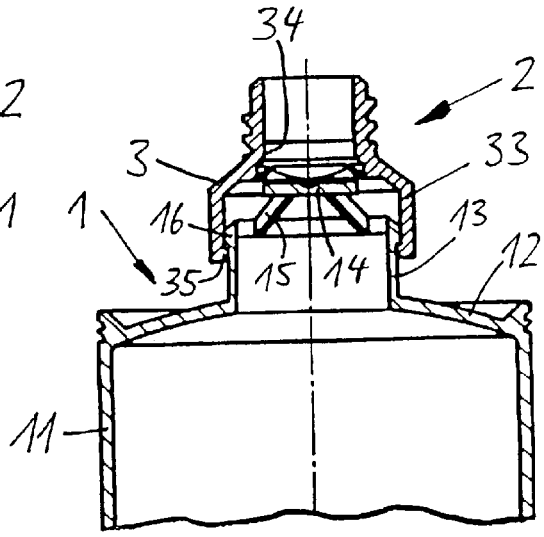
Figure 4:
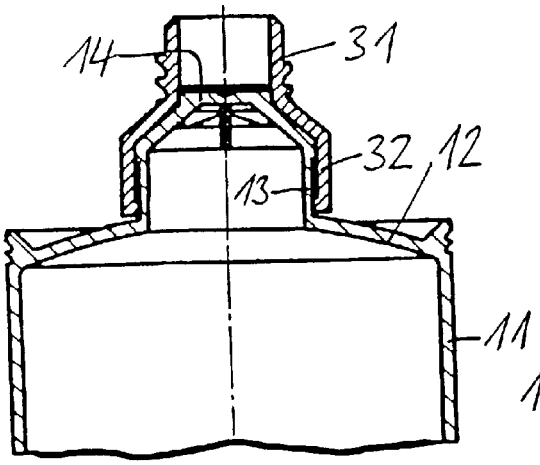
Figure 5:
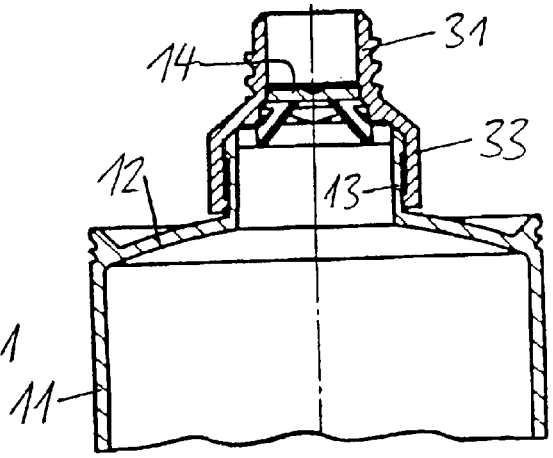
Figure 6:
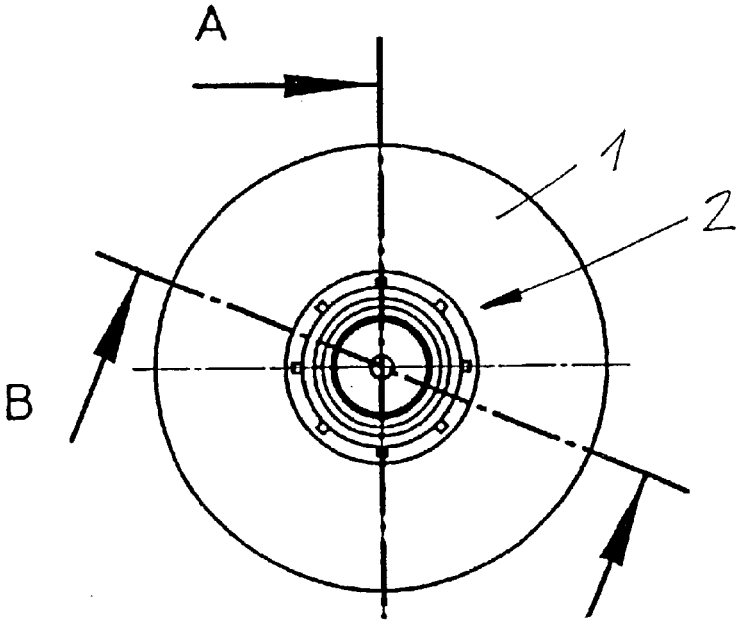
FIG. 6 is a top view of the cartridge of the second embodiment.
Figure 7:
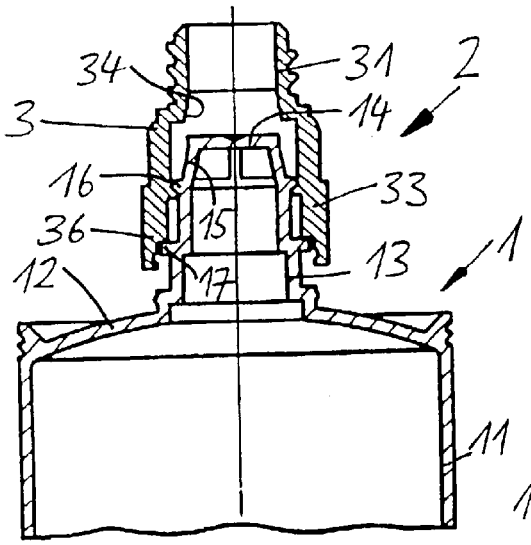
FIG. 7 is sectional view taken along line A—A of FIG. 6 with the nozzle open.
Figure 8:
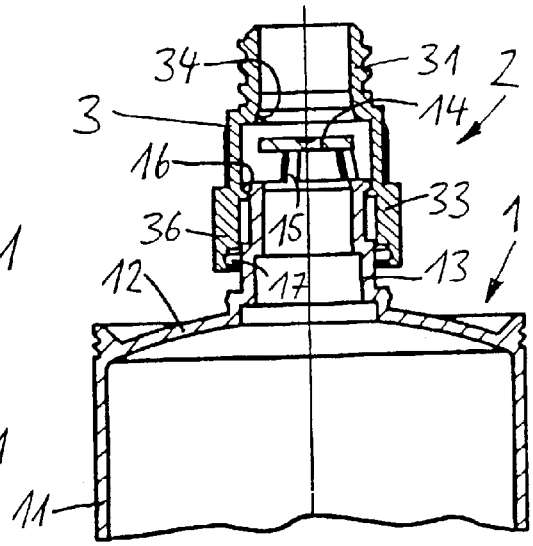
FIG. 8 is a sectional view taken along line B—B of FIG. 6 with the nozzle open.
Figure 9:
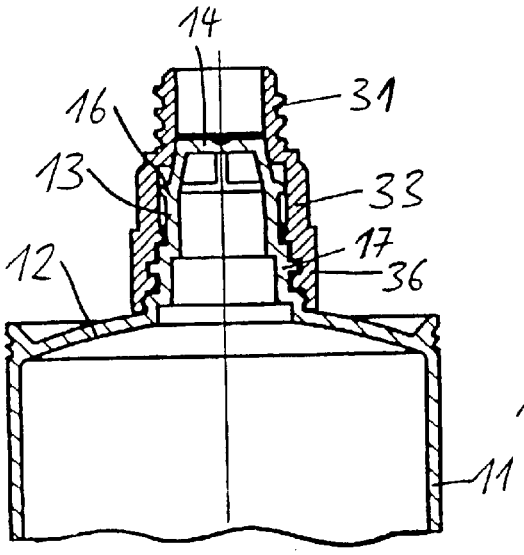
FIG. 9 is a sectional view taken along line A—A of FIG. 6 with the nozzle closed.
Figure 10:
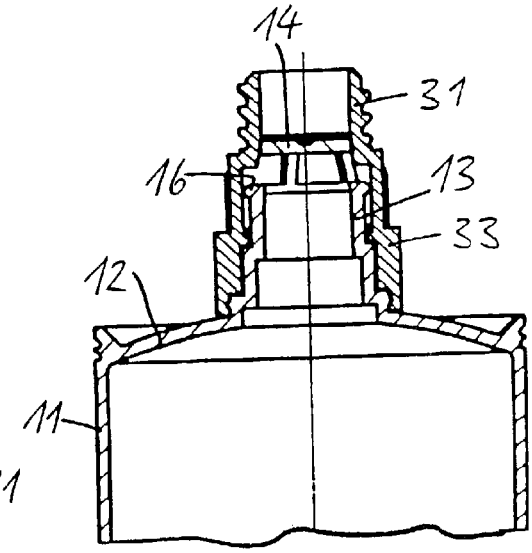
FIG. 10 is a sectional view taken along line B—B of FIG. 6 with the nozzle closed.
Figure 11:
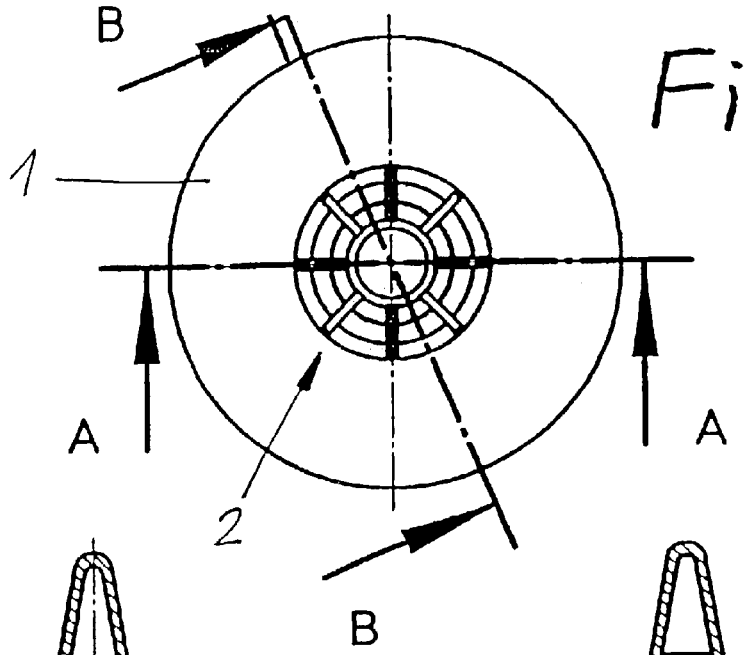
FIGS. 11 to 15 show a third embodiment of the cartridge according to the invention.
Figure 12:
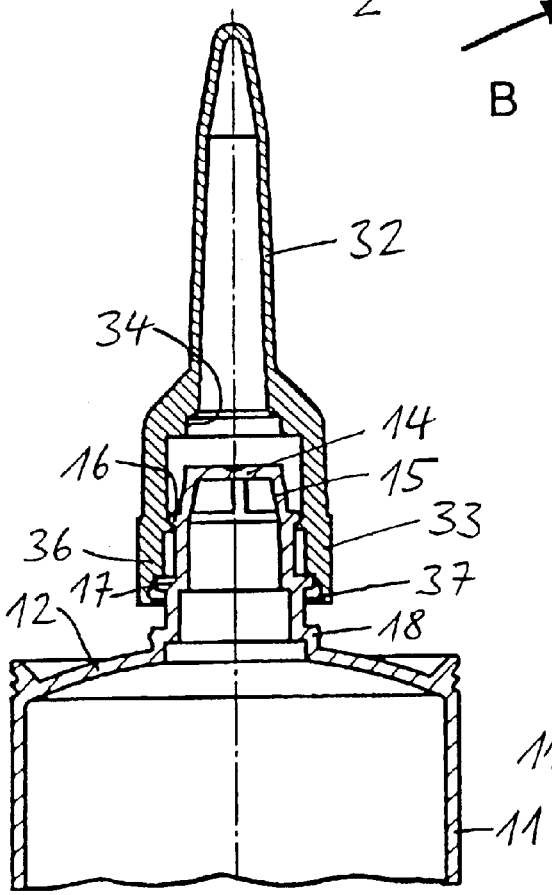
Figure 13:
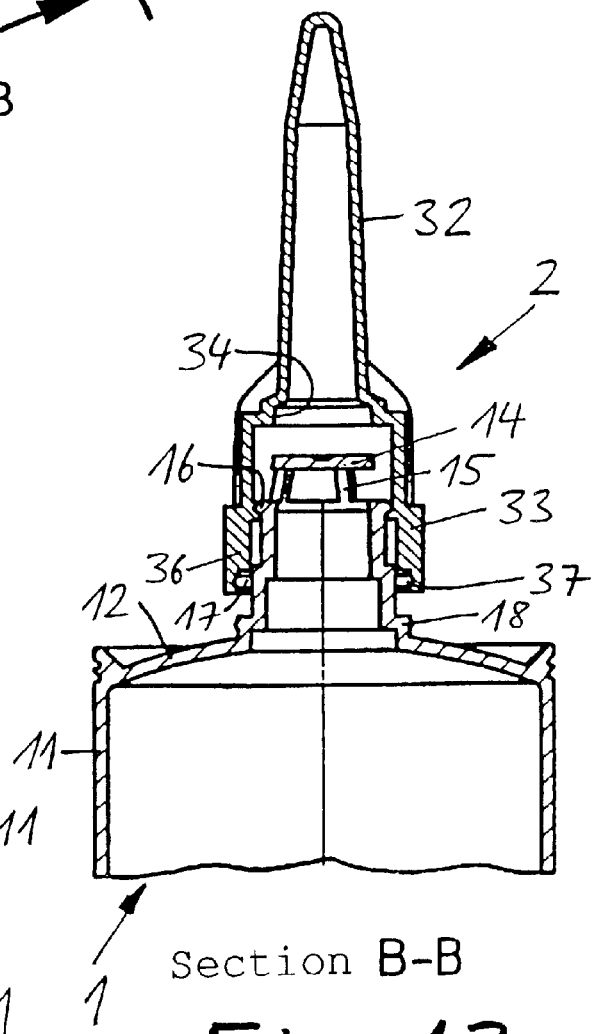
Figure 14:
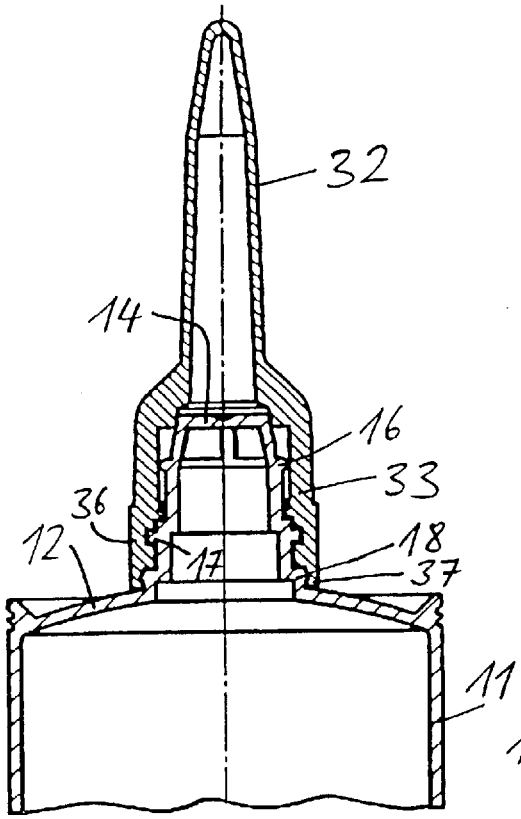
Figure 15:
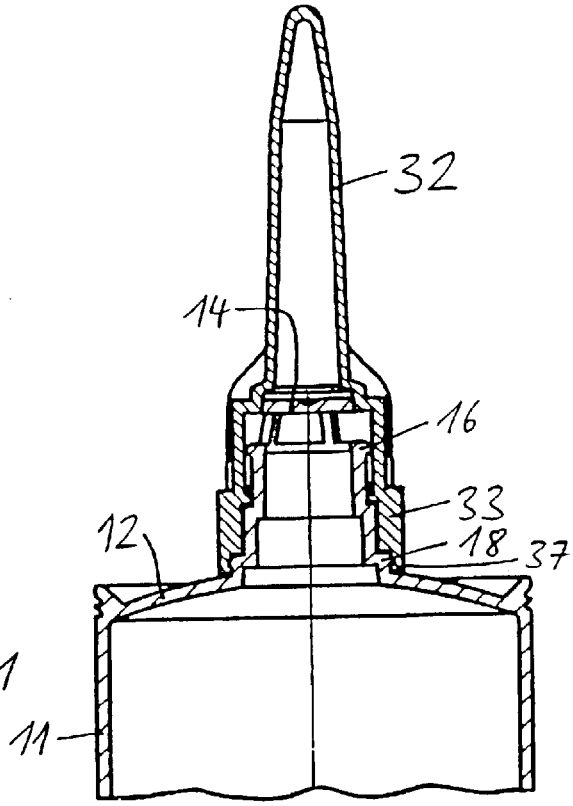

The embodiment shown in FIGS. 1–5 shows a slide arrangement wherein the cartridge is opened and closed by axial displacement of the closure element. In the embodiment according to FIGS. 6–10, the cartridge is opened and closed by rotation of the closure element and FIGS. 11 to 15 show a particular screw arrangement in which the closure member is in the form of a nozzle.

In each of the drawings (FIGS. 1–15), a cartridge 1 with a closure element 2 with opening and closing functions is shown. The sectional views show only the upper end part of the cartridge body with the cartridge tube wall 11 and the front wall 12 thereof and the mouthpiece 13 extending from the front wall 12.

All embodiments include a mouthpiece 13, which, at its front end, includes a closed transverse plate 14, which is connected to the rest of the mouthpiece 13 by an annular arrangement of axial webs 15 so that between the exit end of the closed outer sleeve wall of the mouthpiece 13 and the transverse plate 14 a circular arrangement of side discharge openings is formed between the webs 14.

The cartridge closure 2 with closing and opening means comprises the mouthpiece 13, which is integrally formed with the other parts of the cartridge body and which includes the parts described above and the closure part 3 in the form of a movable sleeve. In the embodiment according to FIGS. 1 to 5, (slide arrangement) and the embodiment according to FIGS. 6–10 (screw arrangement), the closure part 3 is provided at its upper end with an open neck 31 with an external thread for threading a nozzle (not shown) onto it. In the embodiment according to FIGS. 11 to 15, the nozzle is formed integrally with the closure part 3.

In all embodiments, the closure part 3 includes or rear widened sleeve part 33, which provides for the axial movability of the closure part 3 relative to the mouthpiece 13, and a narrowed neck part (in the embodiment according to FIGS. 11 to 15, this is the nozzle 32) whose rearward inner wall area at the transition to the rear sleeve part 33 forms a slightly conical seal surface 34. When the cartridge closure is closed the seal surface 34 forms with the closure part 3, which is then moved back (FIGS. 4 and 5 and, respectively, FIGS. 9 and 10, and FIGS. 14 and 15), a seal provided at the circumference of the mouthpiece 13 in cooperation with the transverse disc 14 having also a slightly conical circumferential surface area. With the conical surface areas in engagement with each other a perfect seal is obtained.

In the open position (FIGS. 2 and 3, or respectively, FIGS. 7 and 8 and FIGS. 12 and 13), the closure part 3 is in a position in which it is slightly displaced axially outwardly on the mouth piece 13, so that the cartridge material can flow out of the cartridge through the side discharge openings 15 at the front end of the mouthpiece into the rear widened interior space of the closure part 3 and axially past the transverse disc 14 into the neck 31 or, respectively, the nozzle 32.

In the slide embodiment (FIGS. 1 to 5), a rear internal shoulder 35 extends inwardly from the sleeve part 33 behind an outer shoulder at the front end of the mouthpiece 13. The outer shoulder 16 of the mouthpiece 13 sealingly engages the inner cylindrical surface of the sleeve part 33. The size relationships are so selected that there is a sufficiently large friction to retain the closure part in any position sufficiently firmly so that it does not move axially without being moved by a user. The closed position may be secured or defined by a small detent at the rear end of the slide path (not shown).

In the screw embodiment (FIGS. 6 to 10), the rear end of the sleeve part 33 and the mouthpiece 13 cooperate by way of complementary thread elements 17, 36 in such a way, that a rotation of the closure part 3 is converted, by way of the thread connection, to an axial movement of the closure part 3. Also with this threaded embodiment an outer shoulder 16 is provided at the front end of the closed part of annular portion of the mouthpiece 13, which shoulder 16 sealingly engages the cylindrical inner wall of the sleeve part 33. This is also true for the embodiment according to FIGS. 11 to 15, which is in this respect the same as that of FIGS. 6 to 10.

The cooperation of the outer shoulder 16 of the mouthpiece 13 and the cylindrical inner wall area of the sleeve part 33 prevents that any material of the cartridge fill material flows backward into the gap between the sleeve part 33 and the mouthpiece 13 and contaminates this area.

In the embodiments according to FIGS. 6 to 10, and 11 to 15 with screw action, in the closed position, that is, at the rearward end of the rotational movement of the closure part, an engagement structure by way of complementary elements 18 and 37 on the mouthpiece 13 and the sleeve part 33 may be provided, which has the advantage that it becomes noticeable to the user when the closing position has been reached.

What is claimed is:

1. A cartridge closure with opening and closing means comprising a mouthpiece (13) with an open end, a closure part (3) having a sleeve portion (33) axially movably supported on said mouthpiece (13) between a closing position and an opening position, said mouthpiece (13) having a transverse wall (14) which is supported in spaced relationship from said open end of said mouthpiece (13) by support webs (15) extending between the open end of said mouthpiece and said transverse wall (14) and said closure part (3) including a neck portion (31) of a smaller diameter than said sleeve portion (33) with a transition area between the neck portion (31) and the sleeve portion (33) including a conical seal surface area (34) which, in the closing position of the sleeve portion (33) sealingly engages a circumferential edge of said transverse wall (14).

2. A cartridge closure according to claim 1, wherein said mouthpiece (13) is formed integrally with a front wall (11) of said cartridge.

3. A cartridge closure according to claim 1, wherein said mouthpiece (13) includes at its open end an annular shoulder (16) which, in the closed position of said closure part (3), sealingly engages the transition area between the neck portion (31) and the sleeve portion (33) of the closure part (3).

4. A cartridge closure according to claim 1, wherein said mouthpiece (13) and said sleeve portion (33) which is axially movably supported on said mouthpiece (13) includes shoulder structures (35, 16) for limiting the axial movement of said closure element (3).

5. A cartridge closure according to claim 1, wherein said portion (33) is mounted onto said mouthpiece (13) by way of a thread.

6. A cartridge closure according to claim 1, wherein said mouthpiece (13) and said sleeve portion (33) have cooperating engagement structure (18, 37) for engagement in the closing position of the closure element (3).

7. A cartridge closure according to claim 1, wherein the neck portion (31) of the closure part (3) is provided with a circumferential thread for the mounting of a discharge nozzle.

8. A cartridge closure according to claim 1, wherein the closure part (3) is provided with an integral discharge nozzle (32).

9. A cartridge closure according to claim 1, wherein the transverse wall (14) is provided with a circumferential edge which is conical complementary to the seal surface area (34) of the closure part (3).

* * * * *